US010847934B2

(12) United States Patent
Gan

(10) Patent No.: US 10,847,934 B2
(45) Date of Patent: Nov. 24, 2020

(54) ELECTRICAL CONNECTORS FOR FLAT CIRCUITS

(71) Applicant: HEWLETT-PACKARD DEVELOPMENT COMPANY, L.P., Houston, TX (US)

(72) Inventor: Jian-Fei Gan, ChongQing (CN)

(73) Assignee: Hewlett-Packard Development Company, L.P., Spring, TX (US)

( * ) Notice: Subject to any disclaimer, the term of this patent is extended or adjusted under 35 U.S.C. 154(b) by 89 days.

(21) Appl. No.: 16/306,151

(22) PCT Filed: Sep. 22, 2016

(86) PCT No.: PCT/US2016/052988
§ 371 (c)(1),
(2) Date: Nov. 30, 2018

(87) PCT Pub. No.: WO2018/056972
PCT Pub. Date: Mar. 29, 2017

(65) Prior Publication Data

US 2020/0328560 A1 Oct. 15, 2020

(51) Int. Cl.

| | |
|---|---|
| ***H01R 13/641*** | (2006.01) |
| ***H01R 12/72*** | (2011.01) |
| ***H01R 12/88*** | (2011.01) |
| ***H01R 12/79*** | (2011.01) |
| ***H01R 12/59*** | (2011.01) |

(52) U.S. Cl.
CPC ..... *H01R 13/641* (2013.01); *H01R 12/592* (2013.01); *H01R 12/725* (2013.01); *H01R 12/79* (2013.01); *H01R 12/88* (2013.01)

(58) Field of Classification Search
CPC .. H01R 13/641; H01R 12/592; H01R 12/725; H01R 12/79; H01R 12/88; H01R 4/16; H01R 12/59; H01R 12/77; H01R 12/78
USPC ..... 439/489, 329, 492–499, 260
See application file for complete search history.

(56) References Cited

U.S. PATENT DOCUMENTS

| | | | | |
|---|---|---|---|---|
| 4,850,892 | A | 7/1989 | Clayton et al. | |
| 6,352,442 | B1 | 3/2002 | Kudo | |
| 7,682,184 | B2 | 3/2010 | Ko et al. | |
| 7,950,952 | B2 | 5/2011 | Susuki et al. | |
| 7,955,107 | B1 * | 6/2011 | Pao | H01R 12/88 439/260 |
| 8,142,220 | B2 * | 3/2012 | Burns | H01R 13/64 439/488 |
| 8,550,849 | B2 | 10/2013 | Yamaji | |

(Continued)

FOREIGN PATENT DOCUMENTS

| | | |
|---|---|---|
| JP | 2008098105 A | 4/2008 |
| JP | 2015005405 A | 1/2015 |

(Continued)

*Primary Examiner* — Travis S Chambers
(74) *Attorney, Agent, or Firm* — HPI Patent Department

(57) ABSTRACT

In one example an electrical connector is disclosed, which may include a housing and a plurality of electrical contacts disposed in the housing for engaging with corresponding connecting terminals provided on a flat circuit. The housing may include a front portion defining an elongated opening and a rear portion opposite the front portion. The rear portion may define a visible area. The flat circuit may be inserted in the housing from the elongated opening and extended into the visible area.

12 Claims, 3 Drawing Sheets

(56) References Cited

U.S. PATENT DOCUMENTS

| | | | | |
|---|---|---|---|---|
| 8,579,654 | B2 * | 11/2013 | Chen | H01R 12/61 439/495 |
| 9,300,067 | B2 | 3/2016 | Yokoo | |
| 9,318,820 | B2 | 4/2016 | Niitsu et al. | |
| 9,401,554 | B2 * | 7/2016 | Takane | H01R 12/79 |
| 2015/0372406 | A1 * | 12/2015 | Kajiura | H01R 12/774 439/329 |

FOREIGN PATENT DOCUMENTS

| | | | |
|---|---|---|---|
| JP | 2015018999 | A | 1/2015 |
| RU | 2072119 | C1 | 1/1997 |
| RU | 2299504 | C1 | 5/2007 |
| RU | 2448397 | C2 | 4/2012 |

* cited by examiner

ELECTRICAL CONNECTORS FOR FLAT CIRCUITS

BACKGROUND

Electrical connectors may be used to form electrical connections between connecting terminals of flat circuits and circuit terminals of circuit boards. A wide variety of electrical connectors have been designed for connecting flat cables or circuits, such as flat flexible cables (FFCs), flexible printed circuits (FPCs) or the like. A connector for flat circuits may include a dielectric housing molded of plastic material, for instance. The housing may have an elongated opening or slot for receiving an end of the flat circuit which has generally parallel, laterally spaced conductors/connecting terminals exposed across the end. A plurality of electrical contacts may be mounted in the housing and are spaced laterally along the opening, with contact portions of the electrical contacts engageable with the laterally spaced conductors of the flat circuit.

BRIEF DESCRIPTION OF THE DRAWINGS

Examples are described in the following detailed description and in reference to the drawings, in which.

DETAILED DESCRIPTION

Figure 1:
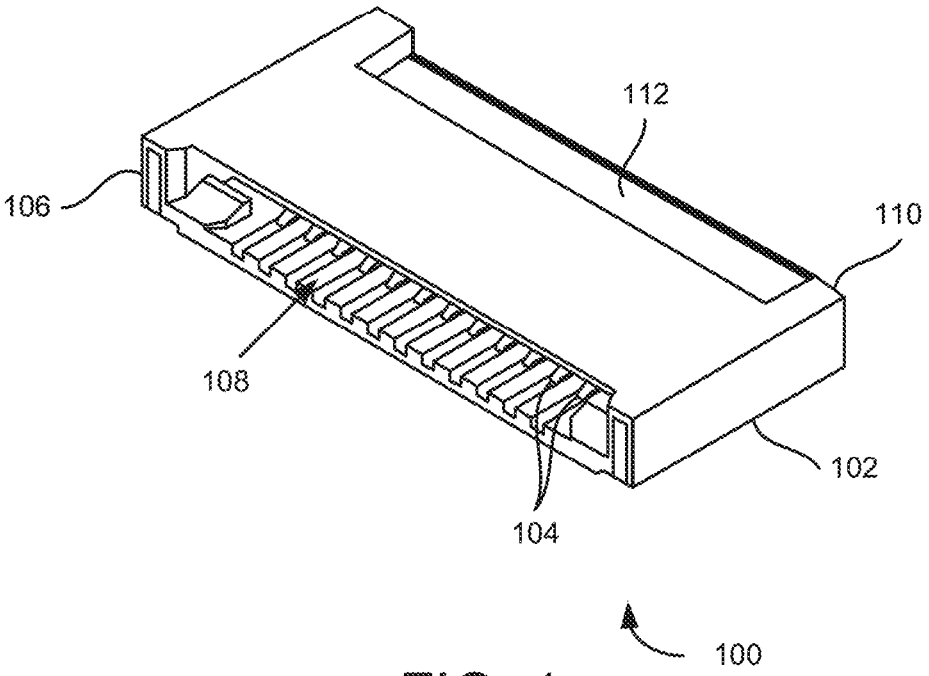
FIG. 1 is a perspective view of an example electrical connector.

Electrical connectors for flat circuits may include a housing having an elongated opening for receiving an end of a flat circuit. A plurality of electrical contacts may be mounted in the housing and are spaced laterally along the elongated opening, with contact portions of the electrical contacts engageable with laterally spaced connecting terminals of the flat circuit. Further, an actuator/cover may be movably mounted on the housing for movement between a first position whereat the flat circuit is freely insertable into the elongated opening and a second position whereat the actuator clamps the flat circuit in the housing and biases the flat circuit against the contact portions of the electrical contacts.

To connect the flat circuit to the electrical connector, a tip of the flat circuit may be inserted into the elongated opening of the electrical connector, which is provided with the plurality of electrical contacts. Because the tip of the flat circuit may be soft due to its flexibility, it might be difficult to confirm/identify whether the tip of the flat circuit is fully inserted into the electrical connector. If the tip of the flat circuit is partially inserted into the electrical connector, the electrical connector assembly may get disconnected when the electrical connector and/or the flat circuit is subjected to vibrations or impacts during shipment. Further, the partially inserted flat circuit may be prone to crosswise insertion relative to the electrical connector, which can cause faulty electrical connections between the flat circuit and the electrical connector. In existing methods, upon cosing the cover after insertion of the flat circuit, the tip of the flat circuit (e.g., contact area) may become invisible and may be difficult to check whether the flat circuit is correctly assembled, even with a stop line provided on the flat circuit. Also, repeated insertion of the flat circuit may abrade flat circuit pins at the tip and may cause connection issue.

Examples described herein may provide an electrical connector for providing electrical connection between circuit terminals on a circuit board and corresponding connecting terminals provided on a flat circuit. In one example, the electrical connector may include a housing, and a plurality of electrical contacts disposed in the housing for engaging with the corresponding connecting terminals provided on the flat circuit. The housing may include a front portion defining an elongated opening, and a rear portion opposite the front portion. The rear portion may define a visible area. The flat circuit may be inserted in the housing from the elongated opening and extended into the visible area.

In one example, the housing may include an extended edge parapet at the rear portion defining the visible area. For example, the extended edge parapet may extend beyond a contact area at which the electrical contacts engages with the corresponding connecting terminals provided on the flat circuit. Further, the flat circuit may include an identification mark at a tip of the flat circuit and a contact area substantially adjacent to the identification mark. The flat circuit inserted into the housing may form electrical connections with corresponding electrical contacts when the identification mark at the tip of the flat circuit is extended into the visible area to touch the extended edge parapet.

Example electrical connectors described herein may provide easy assembly for flat circuits (e.g., flat flexible cable (FFC) or flat printed circuit (FPC)) and may be easy to identify whether the flat circuit is correctly assembled and connected to electrical contacts of the electrical connector. Examples described herein may reduce skill involved to assemble the flat circuit as a user/operator can view the tip of the flat circuit extended in the visible area. Examples described herein may enable to identify whether the flat circuit is correctly assembled as the user/operator can check the flat circuit insertion status via the tip of the flat circuit which can be viewed in the visible area. Since the flat circuit's contact area is not at the tip of the flat circuit, the electrical connectors described herein may not have intermittent issue, may not have flat circuit abrasion issue and may enable connection even if the flat circuit is partially inserted. Further, quality of flat circuit's tip area may not cause connection issue. Examples described herein may provide reliability and durability even when the flat circuit is removed and inserted multiple times and may ensure connection even when flat circuit's pin is peeled off at the tip.

Referring to Figures, FIG. 1 is a perspective view of an example electrical connector 100 for connecting a flat circuit (not shown). Example connector may include an FFC connector or an FPC connector. The term "flat circuit" herein and in the claims hereof is intended to refer to all kinds of flat electrical cables, including but not limited to flat flexible circuits, flexible printed circuits, flat rigid and flexible cables or the like. For example, the flat circuit can have a plurality of generally parallel, laterally spaced conductors. The insulation of the flat circuit is removed at least along one side thereof and substantially next to a tip thereof to expose portions of the conductors for making electrical connections with electrical connector 100.

Electrical connector 100 may include a housing 102 and a plurality of electrical contacts 104 disposed in housing 102 for engaging with corresponding connecting terminals provided on the flat circuit. Example housing may be a dielectric housing, which may be unitarily molded of plastic material. Example electrical contacts 104 are stamped of conductive sheet metal material. Housing 102 may include a front portion 106 defining an elongated opening 108 into which an end of the flat circuit is inserted. Elongated opening 108 may be spaced from one end of housing 102 and extends towards other end of housing 102. Further, housing 102 may include a rear portion 110 opposite front portion 106. Rear portion 110 may define a visible area 112.

In one example, the flat circuit may be inserted in housing 102 from elongated opening 108 and extended into visible area 112. In this case, an opening slot may be provided that extends inwardly from elongated opening 108 defined in front portion 106 to visible area 112 in rear portion 110. In one example, the flat circuit may include an identification mark at a tip of the flat circuit. The identification mark may be visible in visible area 112 defined at rear portion 110 of housing 102 upon inserting the flat circuit in housing 102. In one example, housing 102 may include an extended edge parapet at rear portion 110 defining visible area 112, which is explained in detail in FIG. 2.

Figure 2:
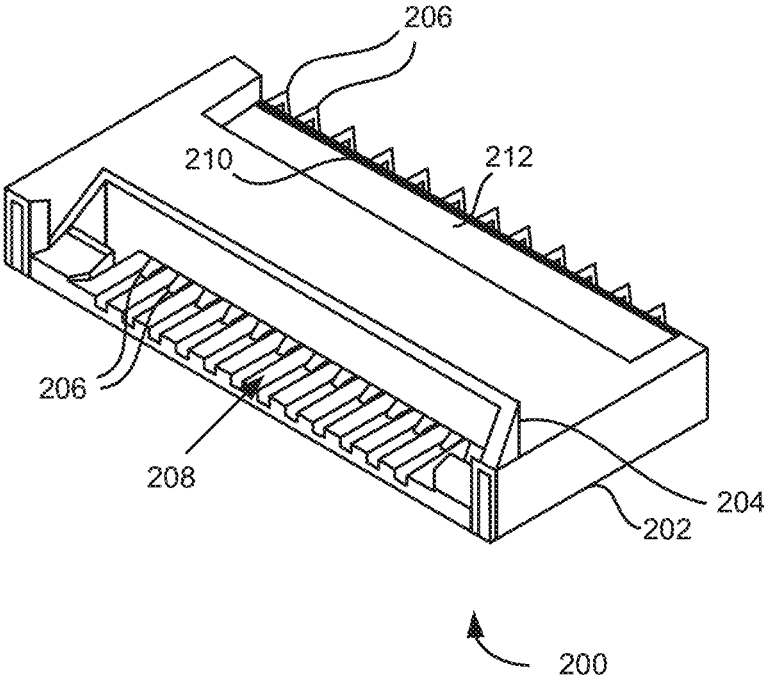
FIG. 2 is a perspective view of another example electrical connector, depicting a base member and a cover member.

FIG. 2 is a perspective view of another example electrical connector 200, depicting a base member 202 and a cover member 204. Electrical connector 200 may include base member 202 provided to be mounted on a circuit board. Further, electrical connector 200 may include a plurality of electrical contacts 206 disposed on base member 202 to be electrically connected respectively with circuit terminals provided on the circuit board and positioned to correspond respectively to connecting terminals provided on a flat circuit.

Electrical connector 200 may include cover member 204 mounted on base member 202. In one example, cover member 204 may be pivotally connected to base member 202. For example, cover member 204 may include a pair of pivots formed at two longitudinal ends of an opposite side thereof and assembled to a pair of receiving portions defined in base member 202. Cover member 204 may be mounted on base member 202 for rotational movement between an open position allowing insertion of the flat circuit into elongated opening 208 and an actuating position biasing the flat circuit against contact portions of electrical contacts 206. For example, to bias the flat circuit against contact portions, cover member 204 may be slidable relative to base member 202 between a close position and a lock position at which rotation of cover member 204 may be prevented and that the flexible circuit is fixed to base member 202.

Base member 202 may include an elongated opening 208 in a front portion, and an extended edge parapet 210 in a rear portion defining a visible area 212. In one example, extended edge parapet 210 may define a rear wall that extends beyond a contact area at which electrical contacts 206 engages with the corresponding connecting terminals provided on the flat circuit. As explained in FIG. 1, the flat circuit may be inserted into base member 202 from elongated opening 208 and extended into visible area 212 to touch extended edge parapet 210. This is explained in detail in FIGS. 3 and 4.

Figure 3:
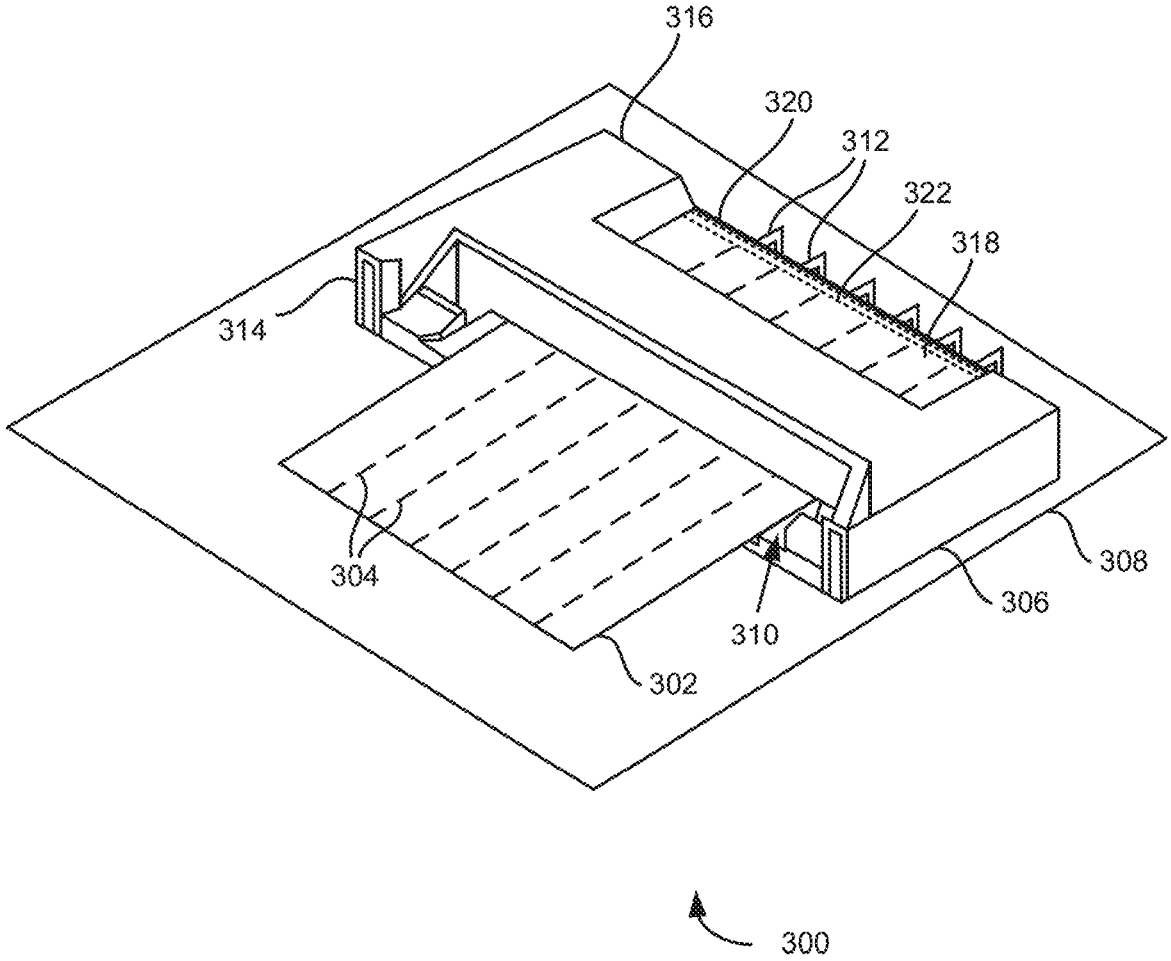
FIG. 3 is a perspective view of an example electrical connector assembly, depicting insertion of a flat circuit into the housing from an elongated opening and extended into a visible area.

FIG. 3 is a perspective view of an example electrical connector assembly 300, depicting a flat circuit 302 inserted into a housing 306 from an elongated opening 310 and extended into a visible area 318. Electrical connector assembly 300 may provide electrical connection between contact elements/circuit terminals on a circuit board 308 and corresponding connecting terminals 304 provided on flat circuit 302.

Electrical connector assembly 300 may include flat circuit 302 having a plurality of parallel, laterally spaced connecting terminals 304. Further, electrical connector assembly 300 may include a housing 306 mounted on circuit board 308 and having an elongated opening 310 to receive an end of flat circuit 302. Furthermore, electrical connector assembly 300 may include a plurality of electrical contacts 312 disposed in housing 306 to be electrically connected respectively with circuit terminals provided on circuit board 308 and positioned to engage with corresponding one of connecting terminals 304 provided on flat circuit 302.

In one example, electrical contacts 312 mounted on housing 306 and spaced along elongated opening 310, each electrical contact 312 may have a tail portion, positioned along rear portion 316 for connection to an appropriate trace on circuit board 308, and a contact portion extending along elongated opening 310 for engaging an appropriate conductor on flat circuit 302. The tail portion of electrical contacts 312, which project outwardly relative to housing 306, may be connected to appropriate trace on circuit board 308, by soldering, to secure housing 306 to circuit board 308.

In one example, housing may include a front portion 314 defining elongated opening 310 and a rear portion 316 defining a visible area 318. Housing may include an extended edge parapet 320 at rear portion 316 defining visible area 318. As shown in FIG. 3, flat circuit 302 is inserted into housing 306 from elongated opening 310 and extended into visible area 318. Flat circuit 302 may have an identification mark 322 at a tip end that is inserted in housing 306, which can be viewed in visible area 318. In one example, flat circuit 302 inserted into housing 306 may form electrical connections with corresponding one of electrical contacts 312 when identification mark 322 at the tip of flat circuit 302 is extended into visible area 318 till extended edge parapet 320. In this case, a user/operator can view the tip (i.e., identification mark 322) of flat circuit 302 exposed in visible area 318 and check the flat circuit insertion status.

Figure 4A:
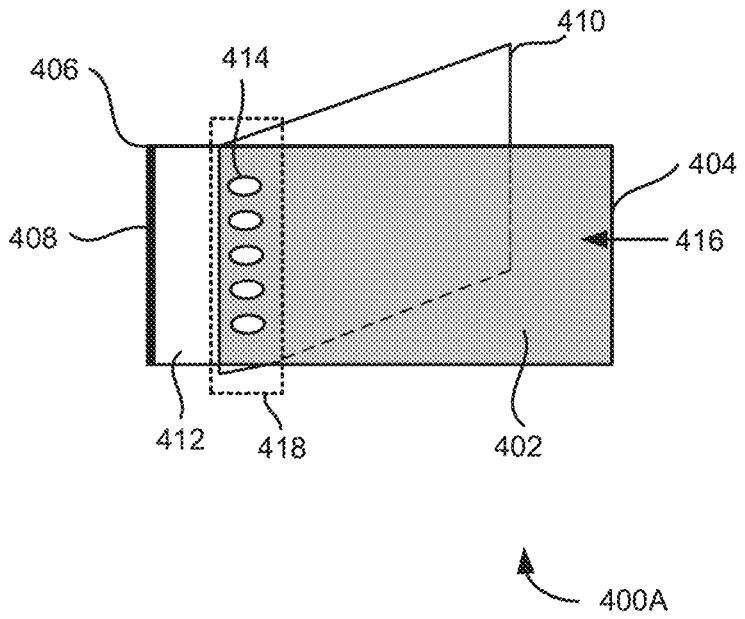
FIG. 4A is a schematic diagram of an example electrical connector, depicting a contact area and a visible area defined in the housing.
Figure 4B:
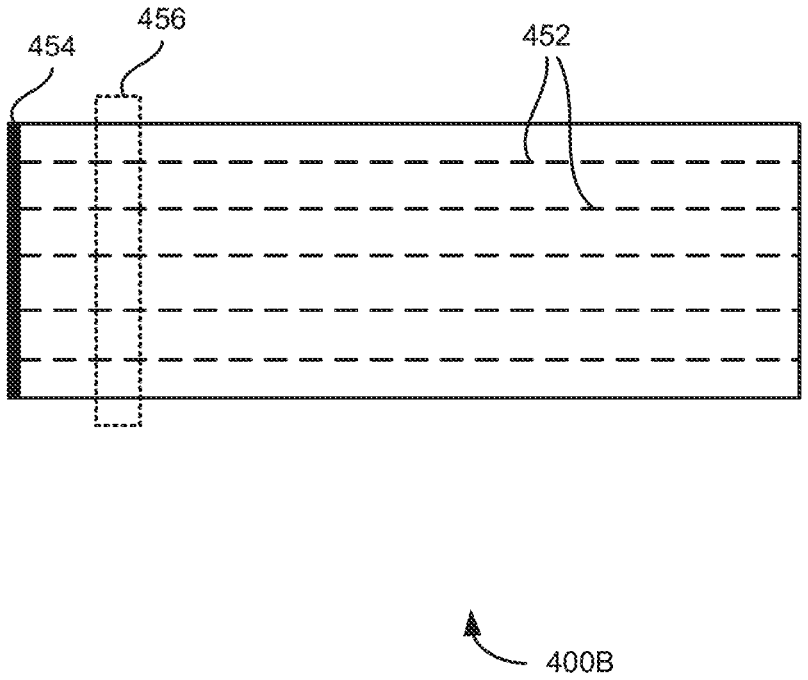
FIG. 4B is a schematic diagram of an example flat circuit, depicting an identification mark at a tip of the flat circuit and a contact area substantially adjacent to the identification mark.

FIG. 4A is a schematic diagram of an example electrical connector 400A, depicting a contact area 418 and a visible area 412 defined in housing. Electrical connector 400A may include a base member 402 provided to be mounted on a circuit board, and a plurality of electrical contacts 414 disposed on base member 402 and positioned to correspond respectively to connecting terminals 452 provided on flat circuit 400B. FIG. 4B is a schematic diagram of an example flat circuit 400B, depicting an identification mark 454 at a tip of flat circuit 400B and a contact area 456 substantially adjacent to identification mark 454. Flat circuit 400B may include laterally spaced connecting terminals 452. Example flat circuit 400B may include a flexible flat circuit or hard flat circuit, such as flat flexible circuits, flexible printed circuits, flat rigid and flexible cables or the like.

Further, electrical connector 400A may include a cover member 410 pivotally mounted on base member 402. In one example, base member 402 and cover member 410 may form a housing for electrical connector 400A. Further, base member 402 may include an elongated opening 416 in a front portion 404. Also, base member 402 may include an extended edge parapet 408 in a rear portion 406 defining visible area 412. Extended edge parapet 408 may extend beyond a contact area 418 at which electrical contacts 414 engages with the corresponding one of connecting terminals 452 provided on flat circuit 400B. In one example, flat circuit 400B inserted into housing may form electrical connections with corresponding one of electrical contacts 414 when identification mark 454 at the tip of flat circuit 400B is extended into visible area 412 and touches extended edge parapet 408. In another example, visible area 412 may include a stop line such that flat circuit 400B inserted into the housing may be extended into visible area 412 such that the identification mark 454 of flat circuit 400B coincides with the stop line provided in visible area 412.

Even though FIGS. 2 and 4A describe an electrical connector with cover member pivotally connected to base member for biasing the flat circuit against electrical contacts of housing, examples described herein can also be applicable to other types of electrical connectors such that the electrical connector defines a visible area at the rear portion to check insertion status of a flat circuit. Example of one such other type of electrical connector may include an actuator, which may include a slide member which is designed to be inserted into the elongated opening together with the flat circuit and to press the electrical contacts of housing against the flat circuit. Each of the housing and cover member may be a one-piece structure unitarily molded of dielectric material such as plastic or the like. The electrical contacts may be stamped and formed of sheet metal material.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All of the features disclosed in this specification (including any accompanying claims, abstract and drawings), and/or all of the steps of any method or process so disclosed, may be combined in any combination, except combinations where at least some of such features and/or steps are mutually exclusive.

The terms "include," "have," and variations thereof, as used herein, have the same meaning as the term "comprise" or appropriate variation thereof. Furthermore, the term "based on," as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. An electrical connector comprising:
a housing comprising;
a front portion defining an elongated opening; and
a rear portion opposite the front portion, wherein the rear portion defines a visible area, wherein a flat circuit is to be inserted in the housing from the elongated opening and extended into the visible area;
a plurality of electrical contacts disposed in the front portion for engaging with corresponding connecting terminals provided on the flat circuit; and
an extended edge parapet at the rear portion defining the visible area, and wherein the extended edge parapet extends beyond a contact area at which the plurality of electrical contacts engages with the corresponding connecting terminals provided on the flat circuit.

2. The electrical connector of claim 1 , wherein the housing comprises:
a base member comprising an extended edge parapet at the rear portion defining the visible area; and
a cover member pivotally mounted on the base member for rotational movement between an open position allowing insertion of the flat circuit into the elongated opening and an actuating position biasing the flat circuit against contact portions of the electrical contacts, wherein the plurality of electrical contacts is spaced along the elongated opening in the base member.

3. The electrical connector of claim 1 , wherein the flat circuit comprises an identification mark at a tip of the flat circuit, wherein the identification mark is visible in the visible area defined at the rear portion of the housing upon inserting the flat circuit in the housing.

4. The electrical connector of claim 1, comprising a flexible flat cable (FFC) connector or a flat printed circuit (FPC) connector, and wherein the flat circuit comprises a flexible flat circuit or hard flat circuit.

5. An electrical connector comprising:
a base member provided to be mounted on a circuit board, wherein the base member comprises:
an elongated opening in a front portion; and
an extended edge parapet in a rear portion defining a visible area, wherein a flat circuit is to be inserted into the base member from the elongated opening and extended into the visible area; and
a plurality of electrical contacts disposed in the front portion to he electrically connected respectively with circuit terminals provided on the circuit board and positioned to correspond respectively to connecting terminals provided on the flat circuit, wherein the extended edge parapet extends beyond a contact area at which the plurality of electrical contacts engages with the corresponding connecting terminals provided on the flat circuit.

6. The electrical connector of claim 5, comprising:
a cover member mounted on the base member for rotational movement between an open position allowing insertion of the flat circuit into the elongated opening and an actuating position biasing the flat circuit against contact portions of the electrical contacts.

7. The electrical connector of claim 5, wherein the flat circuit comprises an identification mark at a tip of the flat circuit, wherein the identification mark is visible in the visible area defined at the rear portion upon inserting the flat circuit in the base member housing.

8. The electrical connector of claim 5, comprising a flexible flat cable (FFC) connector or a flat printed circuit (FPC) connector, and wherein the flat circuit comprises a flexible flat circuit or hard flat circuit.

9. An electrical connector assembly comprising:
a flat circuit comprising a plurality of connecting terminals;
a housing provided to be mounted on a circuit board and comprising an elongated opening to receive the flat circuit, wherein the housing comprises:
a front portion defining the elongated opening;
a rear portion defining a visible area. wherein the flat circuit is inserted into the housing from the elongated opening and extended into the visible area; and an extended edge parapet at the rear portion defining the visible area;

a plurality of electrical contacts disposed in the front portion to be electrically connected respectively with contact elements provided on the circuit board and positioned to engage with corresponding one of the plurality of connecting terminals provided on the flat circuit, wherein the extended edge parapet extends beyond a contact area at which the plurality of electrical contacts engages with the corresponding one of the plurality of connecting terminals provided on the flat circuit.

10. The electrical connector assembly of claim 9, wherein the housing comprises:

a base member comprising an extended edge parapet at the rear portion defining the visible area; and a cover member mounted on the base member for rotational movement between an open position allowing insertion of the flat circuit into the elongated opening and an actuating position biasing the flat circuit against contact portions of the electrical contacts.

11. The electrical connector assembly of claim 9, wherein the flat circuit comprises an identification mark at a tip of the flat circuit and a contact area substantially adjacent to the identification mark.

12. The electrical connector assembly of claim 11, wherein the flat circuit inserted into the housing forms electrical connections with corresponding one of the plurality of electrical contacts when the identification mark at the tip of the flat circuit is extended into the visible area defined in the housing.

* * * * *